US006216281B1

(12) United States Patent
Fricke

(10) Patent No.: US 6,216,281 B1
(45) Date of Patent: Apr. 17, 2001

(54) REMOVABLE SLEEVE LINER FOR GARMENTS

(76) Inventor: Marnie L. Fricke, 262 Arlington Ave., Kensington, CA (US) 94707

( * ) Notice: Subject to any disclaimer, the term of this patent is extended or adjusted under 35 U.S.C. 154(b) by 0 days.

(21) Appl. No.: 09/535,269

(22) Filed: Mar. 23, 2000

Related U.S. Application Data

(60) Provisional application No. 60/126,203, filed on Mar. 25, 1999.

(51) Int. Cl.[7] ..... A41D 27/04
(52) U.S. Cl. ..... 2/272
(58) Field of Search ..... 2/2.5, 16, 59, 90, 2/97, 103, 126, 127, 309, 272

(56) References Cited

U.S. PATENT DOCUMENTS 2,441,122 * 5/1948 Sturz ..... 2/93
2,483,015 * 9/1949 Levy ..... 2/93
4,386,438 * 6/1983 Evin ..... 2/272
4,843,647 * 7/1989 Phillips et al. ..... 2/93
4,864,656 * 9/1989 Nesse ..... 2/97
5,918,315 * 7/1999 Trachtenberg ..... 2/125

* cited by examiner

*Primary Examiner*—John J. Calvert
*Assistant Examiner*—Alissa L. Hoey
(74) *Attorney, Agent, or Firm*—David Dolberg

(57) ABSTRACT

This invention discloses a garment sleeve liner useful for improving the comfort or insulating ability of garments. Depending on the application, the liner is made variously from silk, polyester, cotton or quilted fabric. The liner is tubular and designed to fit comfortably within and along a garment sleeve. The liner has means for attaching to the garment affixed to the shoulder end of the liner. A useful means for attaching the liner to the garment is several rectangular pieces of Velcro® affixed to the shoulder end of the liner.

13 Claims, 3 Drawing Sheets

REMOVABLE SLEEVE LINER FOR GARMENTS

CROSS REFERENCE TO RELATED APPLICATIONS

This application claims the benefit of U.S. Provisional Application No. 60/126,203, filed Mar. 25, 1999, and is entitled to this earlier U.S. effective filing date.

FIELD OF THE INVENTION

This invention relates generally to linings for garments. More specifically, it relates to removable liners for garments.

BACKGROUND OF THE INVENTION

Garments made of materials such as wool, or other coarse, loosely woven materials, present several limitations to the wearer. For instance, many people have sensitive skin. Wool and other garment materials, when worn directly against the skin, cause physical discomfort (itching) for a significant percentage of the population. This can lead to irritation and rash, and many people are unable to wear garments made of wool next to their skin.

Most knitted sweaters commercially available to the consumer do not have a lining. Furthermore, lining a sweater or dress with a permanent liner is expensive and time consuming. Consequently, it would be prohibitively expensive to provide linings for commercial garments and even more so for an individual to have all such garments lined after purchase.

Undergarments provide a barrier between the skin and garment, but undergarments that are generally available have limited use for this problem. For instance, a slip can be worn under a wool dress, but this does not provide protection for the arms. Jacket-style undergarments are not generally available.

Therefore, not many options exist for the protection of the arms of those individuals sensitive to wool or other coarse fabrics, that want to wear sleeved garments made of such material.

Similarly, when used to make garments, the looseness of the weave and porosity of many fabrics, provide an incomplete barrier for ultra violet radiation and also limits the ability of these fabrics to provide thermal insulation or an adequate barrier against wind.

SUMMARY OF THE INVENTION

This invention describes removable liners for sleeves, designed to be used with garments that are made of wool or similar materials. Sleeve liners allow individuals sensitive to wool to wear woolen clothing, such as cardigan sweaters over sleeveless or short sleeved shirts or dresses. Sleeve liners also provide a more complete barrier against wind and ultra-violet penetration from the sun or other sources. Sleeve liners also increase the ability of a garment to provide thermal insulation.

It is an object of this invention to greatly expand the potential applications of an individual's existing wardrobe.

It is an object of this invention to expand the uses and applications for a particular garment.

It is an object of this invention to save the wearer the expense of having garments professionally lined. The cost for having even just two sleeves lined can often exceed the price paid for the garment.

It is an object of this invention to provide liners that can be easily removed and used interchangeably in many different garments.

It is an object of this invention to provide liners with fastening means that independently adhere to the garment.

It is an object of this invention to improve the ultra-violet protection afforded by a garment when worn.

It is an object of this invention to improve the wind protection afforded by a garment when worn.

It is an object of this invention to improve the thermal insulation provided by a garment when worn.

In accordance with the above objectives, and others described herein, this invention provides a removable sleeve liner made from a variety of different fabrics. that can be placed within a garment sleeve and easily affixed to the portion of the garment sleeve closest to the body of the garment.

In an embodiment, the liner is provided with the hook portion of hook and fastener fabric such that attachment to the garment can be accomplished independently, e.g., without any modification of the garment.

In further accordance with the above objects, and others described herein, this invention provides a removable liner for inserting in garment sleeves, said liner comprising a tubular material with a shoulder end and a wrist end and a means for fastening said liner to said sleeve proximal to the shoulder end.

DETAILED DESCRIPTION OF THE INVENTION

The instant invention discloses a removable sleeve liner comprising a sleeve and fasteners. The liner is generally tubular and resembles a typical garment sleeve. Sleeves vary in shape and size, ranging from wide bell shapes to straight, and from the smallest children's sizes to the largest men's sizes. Women's sizes, which are usually intermediate, are also contemplated. Consequently, a variety of sizes and shapes of liner may be manufactured to accommodate the shapes and sizes of typical sleeves.

Figure 2B:
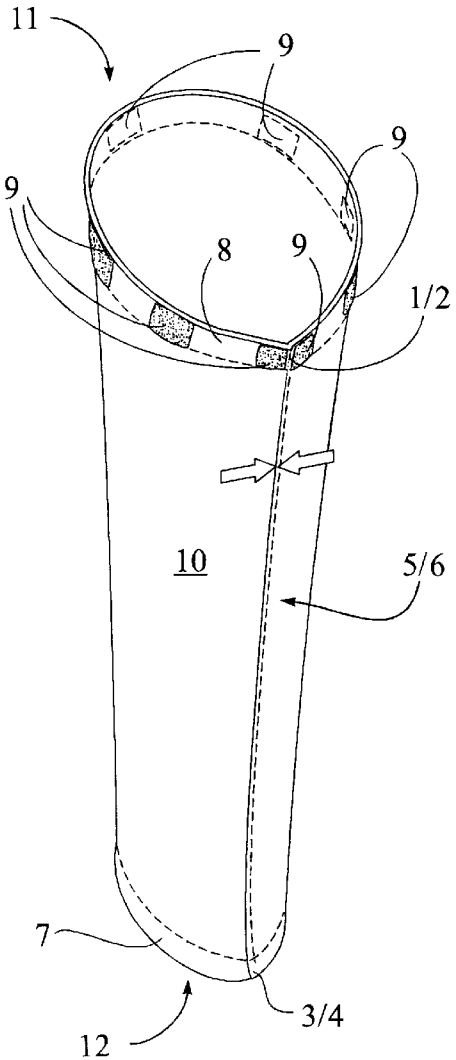
FIGS. 2A & 2B are perspective views of the sleeve liner.
Figure 2A:
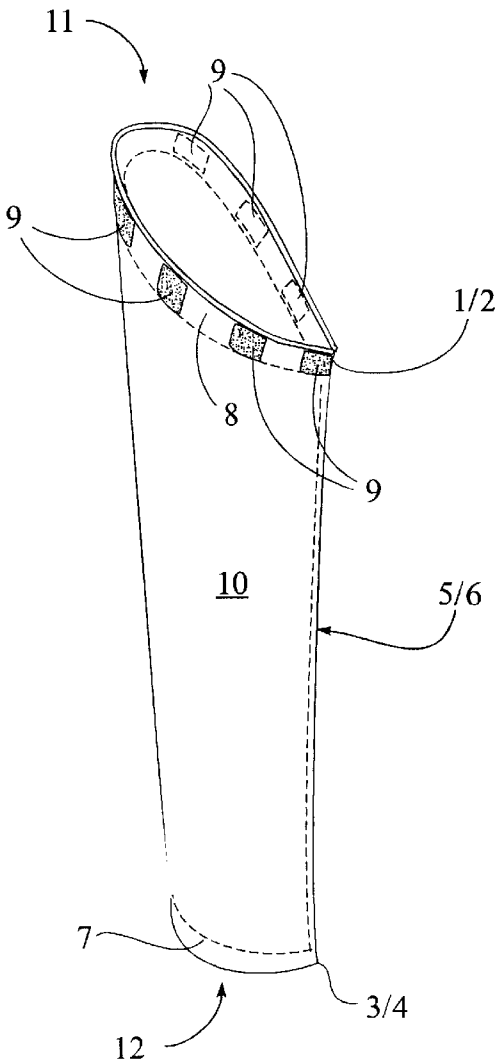

Referring now to FIG. 2, the liner (10) has a shoulder end (11) and a wrist end (12). In an embodiment, the wrist end (12) has a smaller circumference than the shoulder end (11). Typically, the liner is at least 4 inches long and no longer than 40 inches. More typically, the liner is from 18 to 25 inches long. Typically, the liner is at least 4 inches in circumference, but no greater than 34 inches. More typically, the liner is between 8 and 28 inches in circumference.

The liner is identical for the left and right sleeves so the construction of only one unit is illustrated. In an embodiment, the body of the liner itself is made from a single piece of fabric cut to a pattern similar to a sleeve, as shown in FIG. 1.

The fabric used varies depending on the intended use. When used as a comfort barrier from coarse materials such as wool, the fabric is typically a soft material, commonly available, like that used in lining garments, such as polyester, silk, rayon, nylon, cotton and the like. When the preferred use is as a protective barrier from ultra-violet radiation the liner may be manufactured from fabrics with high SPF values of at least 20, preferrably 30 or greater. When the preferred use includes additional thermal insulation, fabrics in addition to those already referred to, such as polar fleece®, lycra and the like, or quilted material such as thermolitet® or the like may be used, separately or in combinations.

Figure 1:
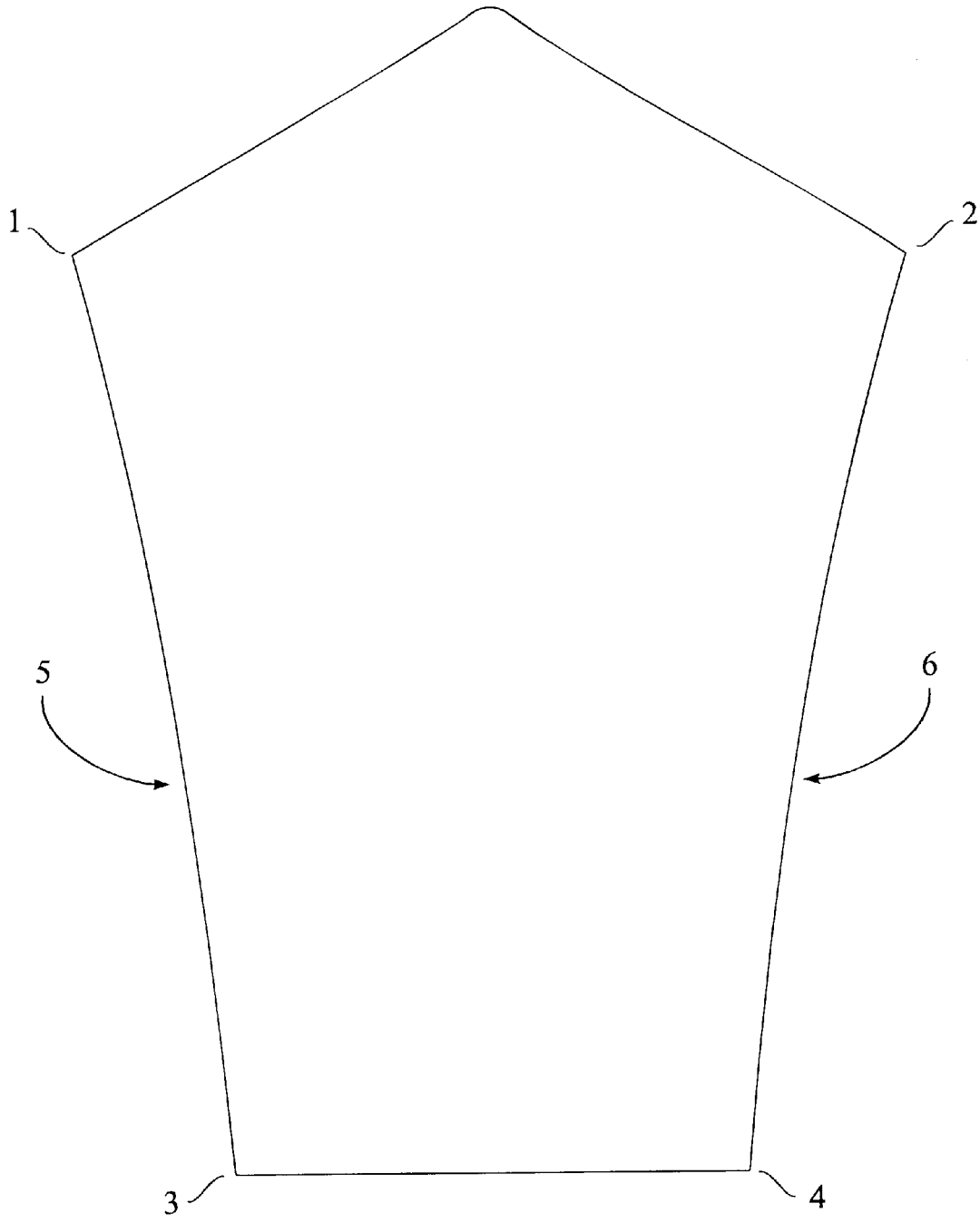
FIG. 1 is the pattern of the material used to construct the sleeve liner.

The fabric is folded lengthwise with the "right side" or "shiny side" on the inside and the first long edge (5) is joined to the second long edge (6), typically by sewing a seam joining the two sides (5/6) and the corners (3/4) and (1/2) of FIG. 1.

The sleeve liner so joined (10) is depicted in FIG. 2. The edges of the shoulder end (11) and wrist end (12) may be finished either by folding the leading edge back toward the "wrong side" or "dull side" of the fabric, and sewing it in place with a seam proximal to the folded edge; or, by sewing separate finishing strips of material (7 & 8) along the raw edges.

The liner is provided with a means for fastening the liner onto the garment sleeve. The fastener could be of any sort such as snaps hooks or buttons. In a preferred embodiment, the means for fastening is composed of hook and loop fastener fabric (such as that commercially available under the mark "Velcro®"). In a particularly preferred embodiment, shown in FIG. 2, the rectangular strips of the hook portion of the Velcro® (9) are attached to the liner on the wrong/dull side of the garment at various locations around the perimeter of the shoulder end (11) and adhere to the garment without requiring attachment of the complimentary loop portion, since the garment fabric itself substitutes for the loop portion and is itself adequate to receive and hold the hook portion.

The means for fastening may be affixed anywhere on the sleeve lining. Preferred locations, either alone or in combination, are: around the perimeter of the shoulder end; along the side seam, or around the perimeter of the wrist end. In an embodiment, the invention has an elastic band incorporated in the seam of the wrist end. Decorative detail, such as lace may also be incorporated upon the liner, preferably at or near the wrist end.

EXAMPLES

Figure 3B:
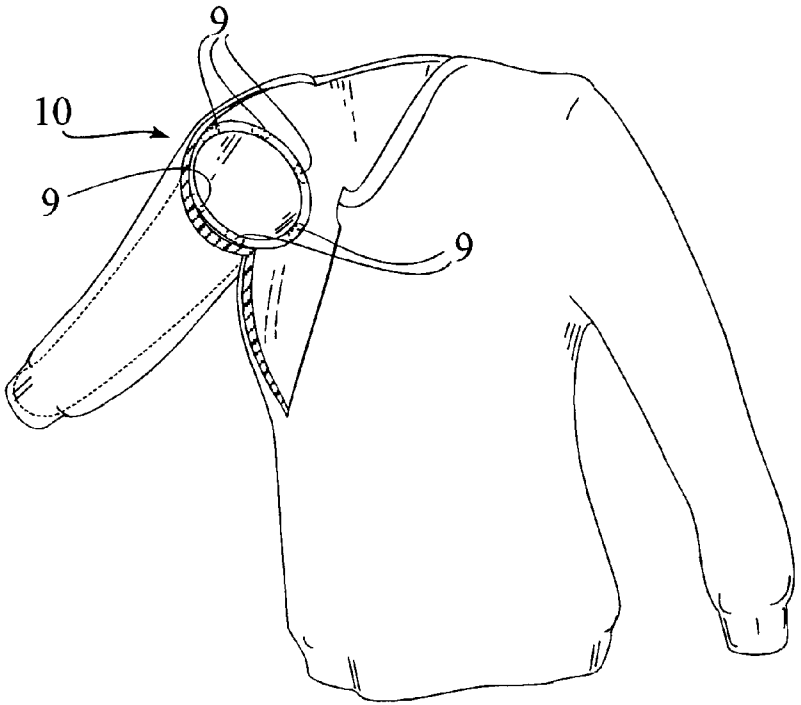
FIG. 3B is a view of the inside of a sweater with the sleeve liner in place.
Figure 3A:
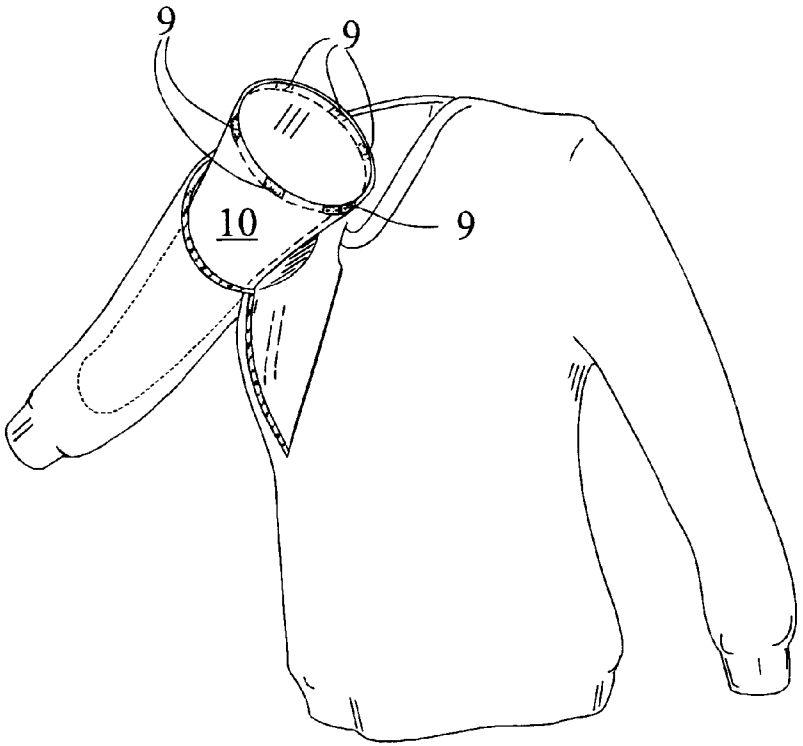
FIG. 3A is a perspective view of a sweater as the sleeve liner is being inserted.

1. This invention is to be used to line any sleeved garment including, but not limited to, knitted sweaters and jackets. This example demonstrates the use of the sleeve liner of the instant invention with a knitted sweater, but it is to be understood that the sleeve liner may be used with any garment. The invention will be best understood by reference to the drawings. The invention is designed for use in both sleeves of a garment, but for simplicity only one sleeve is illustrated throughout. FIG. 3A illustrates the liner (10) being placed inside the right sleeve of a cardigan sweater. The liner attaches to the inside of the sweater at six points by means of small rectangular pieces of the hook portion of Velcrot® (9) which have been sewn onto the sleeve liner (10). In this example, it is not necessary to modify the sweater to use the invention. The Velcro® hooks attachment points (9) on the liner (10) attach directly to the fabric inside of the knitted cardigan as shown in FIG. 3B.

The sleeve liner is easily inserted into the sleeve of the sweater by holding the sweater at the shoulder end with one hand and holding the liner at the wrist end in the other hand. The liner is then inserted into the sleeve of the sweater at the shoulder end. With the seam of the liner aligned with the underarm seam of the cardigan, the invention is pushed through until the wrist ends of the liner and the sweater line up. The liner is then attached at the shoulder end by pressing the Velcro hooks on the invention into the fabric at the attachment points.

The sweater may then be worn normally but more comfortably as there is no direct contact between the wearer's arm and the itchy wool of the sleeve. To keep the invention in place when the cardigan is removed the wearer will hold the sleeve lining at the wrist end, with one hand, while pulling their other arm out.

2. In an alternate embodiment, the complementary rectangular loop portions of the Velcro® are employed to produce a stronger attachment between the invention and the garment. In this embodiment the soft side (or loop side) of the Velcro® fastener is attached (by sewing or using self-adhesive loop Velcro® material) to the garment. This embodiment is most useful in cases where the hook Velcro® strips of the invention do not readily adhere to the fabric of the garment. An example would be when the garment is made of a smoother material such as linen, another fabric that some people find uncomfortable.

In the foregoing, the present invention has been described with reference to suitable embodiments, but these embodiments are only for purposes of understanding the invention and various alterations or modifications are possible so long as the present invention does not deviate from the claims that follow.

What is claimed is:

1. A removable liner for providing a comfort barrier for sleeves of a coarse or irritating garment, said liner comprising a single layer of tubular fabric with a shoulder end and a wrist end, and a means for fastening said liner to said garment sleeve proximal to the shoulder end of the liner.

2. The liner of claim 1 wherein the fastening means of the liner independently adheres to the garment.

3. The liner of claim 1 wherein the fastening means comprises a loop fastening material affixed to the liner.

4. The liner of claim 1 wherein a multiplicity of loop fastening material pieces are affixed to the liner.

5. The liner of claim 1 wherein said tubular fabric is formed from a flat piece of fabric with at least two straight edges by affixing the first edge to the second edge.

6. The liner of claim 1 additionally comprising finishing strips affixed around the perimeters of the shoulder and wrist ends of the liner.

7. A removable liner for providing a comfort barrier for sleeves of a coarse or irritating garment, said liner consisting essentially of a soft piece of material formed into a tubular shape with a shoulder end and a wrist end; and a means for fastening said liner to said garment sleeve proximal to the shoulder end of the liner.

8. The liner of claim 7 wherein the fastening means of the liner independently adheres to the garment.

9. The liner of claim 8 wherein a multiplicity of pieces of loop fastening material are affixed to the liner.

10. The liner of claim 9 additionally consisting of finishing strips affixed around the perimeters of the shoulder and wrist ends of the liner.

11. The liner of claim 7 wherein the fastening means comprises a loop fastening material affixed to the liner.

12. The liner of claim 7 wherein said tubular fabric is formed from a flat piece of fabric with at least two straight edges by affixing the first edge to the second edge.

13. The liner of claim 7 wherein said material is selected from the group consisting of polyester, silk, rayon, nylon, and cotton.

* * * * *